US009700195B2

(12) United States Patent
Padtberg et al.

(10) Patent No.: US 9,700,195 B2
(45) Date of Patent: Jul. 11, 2017

(54) CONVEYOR DISHWASHER AND METHOD FOR OPERATING A CONVEYOR DISHWASHER

(75) Inventors: Klaus Padtberg, Korbach (DE); Harald Disch, Elzach (DE)

(73) Assignee: PREMARK FEG L.L.C., Glenview, IL (US)

( * ) Notice: Subject to any disclaimer, the term of this patent is extended or adjusted under 35 U.S.C. 154(b) by 666 days.

(21) Appl. No.: 14/111,605

(22) PCT Filed: Apr. 4, 2012

(86) PCT No.: PCT/US2012/032037
§ 371 (c)(1),
(2), (4) Date: Oct. 14, 2013

(87) PCT Pub. No.: WO2012/141947
PCT Pub. Date: Oct. 18, 2012

(65) Prior Publication Data

US 2014/0034088 A1 Feb. 6, 2014

(30) Foreign Application Priority Data

Apr. 15, 2011 (DE) ..... 10 2011 007 507

(51) Int. Cl.
*A47L 15/24* (2006.01)
*A47L 15/42* (2006.01)

(52) U.S. Cl.
CPC ..... *A47L 15/241* (2013.01); *A47L 15/4236* (2013.01); *A47L 15/4291* (2013.01); *A47L 15/4219* (2013.01)

(58) Field of Classification Search
CPC . A47L 15/241; A47L 15/4291; A47L 15/4219
See application file for complete search history.

(56) References Cited

U.S. PATENT DOCUMENTS 4,156,621 A 5/1979 Andrews et al.
2007/0023069 A1 2/2007 Berner et al.
(Continued)

FOREIGN PATENT DOCUMENTS

CN 2425612 4/2001
CN 2742916 11/2005
(Continued)

OTHER PUBLICATIONS

International Search Report and Written Opinion, PCT/US2012/032037, Nov. 7, 2012.

*Primary Examiner* — Michael Kornakov
*Assistant Examiner* — Natasha Campbell
(74) *Attorney, Agent, or Firm* — Thompson Hine LLP

(57) ABSTRACT

A conveyor dishwasher has at least one wash zone, at least one final rinse zone, and conveyor apparatus. In order to reduce the consumption of disinfection chemical and energy, but to nevertheless maintain a desired final rinse result, the final rinse liquid which is sprayed in the final rinse zone has a metered disinfection chemical, and at least one additional final rinse zone arranged downstream of the final rinse zone provided for spraying fresh water without a disinfection chemical onto the washware to be treated. The at least one additional final rinse zone has an associated collection device for collecting liquid which is sprayed in the additional final rinse zone. Furthermore, a liquid transfer system is provided, it being possible to supply the liquid which is collected in the collection device directly to the wash zone by means of said liquid transfer system.

18 Claims, 4 Drawing Sheets

(56) References Cited

U.S. PATENT DOCUMENTS

| | | | | |
|---|---|---|---|---|
| 2009/0255556 | A1* | 10/2009 | Warner | A47L 15/4291 134/18 |
| 2011/0017240 | A1 | 1/2011 | Berner et al. | |

FOREIGN PATENT DOCUMENTS

| | | |
|---|---|---|
| CN | 101460085 | 6/2009 |
| CN | 101969831 | 2/2011 |
| CN | 102123647 | 7/2011 |
| DE | 29622760 | 7/1997 |
| DE | 19644438 | 4/1998 |
| DE | 102009024569 | 4/2011 |
| EP | 0838190 | 4/1998 |
| KR | 20100052215 | 5/2010 |
| WO | 2006/007237 | 1/2006 |
| WO | WO 2010019380 | 2/2010 |
| WO | 2010/144307 | 12/2010 |

* cited by examiner

CONVEYOR DISHWASHER AND METHOD FOR OPERATING A CONVEYOR DISHWASHER

The invention relates to a conveyor dishwasher and a method for operating a conveyor dishwasher.

The present invention accordingly relates, in particular, to a conveyor dishwasher having at least one wash zone and at least one final rinse zone, and having a conveyor apparatus for conveying washware through the at least one wash zone and the at least one final rinse zone, with the at least one final rinse zone being arranged downstream of the at least one wash zone, as seen in the conveying direction of the washware which is conveyed by the conveyor apparatus, for spraying final rinse liquid onto the washware to be treated.

The conveyor dishwasher according to the invention is, in particular, a commercial conveyor dishwasher and may be in the form of a flight-type dishwasher (flight-type warewasher) or a rack-conveyor dishwasher (rack-conveyor warewasher).

Conveyor dishwashers (conveyor warewashers) are used in the commercial sector. In contrast to domestic dishwashers, in which the washware to be cleaned remains stationary in the machine during cleaning, in conveyor dishwashers the washware is conveyed through various treatment zones of the machine.

In the case of conveyor dishwashers, the washware, for example dishes, pots, glasses, flatware and other articles which are to be cleaned, is conveyed through a plurality of treatment zones, for example pre-wash zone(s), main-wash zone(s), post-wash or pre-rinse zone(s), final rinse zone(s) and drying zone(s). A conveyor apparatus which generally has compartments for accommodating washware is used to convey washware in a conveying direction through the conveyor dishwasher. In the case of a flight-type dishwasher, the compartments can be formed by supporting fingers on a conveyor belt of the conveyor apparatus. In the case of rack-conveyor dishwashers, dish racks in which compartments can be formed in order to accommodate the washware to be treated serve as the conveyor apparatus. It is feasible here for the dish racks to be conveyed through the rack-conveyor dishwasher by a conveying device.

In the field of commercial dish-cleaning by means of conveyor dishwashers, special requirements in respect of the hygiene performance of cleaning processes have to be taken into consideration. In order to meet the requirements defined in the corresponding (national) standards and guidelines, the washware, after passing through the wash zone(s) of the conveyor dishwasher, is often then disinfected with the aid of a thermal-chemical process in conventional conveyor dishwashers.

Instead of thermal-chemical post-treatment, it is also known to carry out purely chemical disinfection on the washware in a low-temperature process, during which disinfection the temperature of the liquid (wash liquid, final rinse liquid) which is sprayed into the respective treatment zones in the conveyor dishwasher is intentionally not increased for disinfection purposes. In a process of this kind, the temperature of the sprayed wash liquid and final rinse liquid is usually even lowered to approximately 50° C. In order to nevertheless be able to effectively disinfect the washware, a chemical disinfection process is used, in which a liquid to which a chemical disinfectant is admixed, for example a liquid to which sodium hypochlorite (NaOCl) is admixed, an iodine solution or a quaternary ammonium solution is sprayed onto the washware.

In order to achieve a satisfactory hygiene state of the washware after said washware has been treated in the conveyor dishwasher, the chemical disinfection has to be performed in the final rinse zone (final sanitizing zone). In conveyor dishwashers in which a pre-rinse zone (pumped rinse) is used in addition to the final rinse zone, a minimum concentration of disinfection chemical, which is dependent on the type of disinfection chemical used, has to be complied with in said pre-rinse zone. The contact time between the washware and a disinfection solution should be, in principle, at least 7 seconds, specifically either only in the final rinse zone (final sanitizing rinse) or in the pre-rinse zone (pumped rinse) and the final rinse zone (final sanitizing rinse) together.

The minimum concentration of the disinfection chemical in the disinfection solution which comes into contact with the washware depends on the type of disinfection chemical used. When using sodium hypochlorite (NaOCl), for example, it is necessary to use a minimum concentration of 50 ppm.

The problem with conventional conveyor dishwashers which operate with a low-temperature rinsing method in combination with chemical disinfection is that of traces of the disinfection chemical, for example streaks and/or traces of odor, remaining on the washware. These remaining traces of disinfection chemical can be easily identified on vulnerable washware in particular, for example drinking glasses and flatware, and therefore often lead to operators or customers rejecting the low-temperature process in spite of the large potential savings in comparison to thermal processes in which the washware is disinfected by increasing the temperature of the liquid (wash liquid and/or final rinse liquid) which is sprayed during the washware treatment.

In order to eliminate these significant process disadvantages, it is feasible, in principle, to arrange a so-called post-disinfection final rinse zone (post sanitizing rinse) downstream of the final rinse zone in which the chemical disinfection is performed and in which the washware comes into contact with the chemical disinfection component. In this post-disinfection final rinse zone, which is also referred to as the "additional final rinse zone" in the text which follows, the washware is subjected to final rinsing with fresh water, which is of equal quality to drinking water (potable water) in microbiological terms, after passing through a chemical disinfection process in the upstream final rinse zone, in order to remove chemical residues remaining on the dishes after running through the chemical disinfection process in the upstream final rinse zone and to provide a visually satisfactory result.

The invention is based on the problem of developing a conveyor dishwasher of the kind mentioned in the introductory part in such a way that an optimum final rinse result can be achieved while reducing the consumption of, in particular, disinfection chemical and energy for the washware to be treated, and in addition all the requirements in respect of the required hygiene performance are complied with. The invention is further based on the problem of specifying a corresponding method for operating a conveyor dishwasher of this kind.

The invention accordingly relates to an, in particular commercial, conveyor dishwasher of the kind mentioned in the introductory part, that is to say a conveyor dishwasher having at least one wash zone and at least one final rinse zone, and having a conveyor apparatus for conveying washware through the at least one wash zone and the at least one final rinse zone, with, according to the invention, the final rinse liquid which is sprayed onto the washware to be treated in the at least one final rinse zone having a metered disinfection chemical. The invention further makes provision, in addition to the at least one final rinse zone in which final rinse liquid containing a metered disinfection chemical is sprayed, for at least one post-disinfection final rinse zone or additional final rinse zone to be provided which is arranged downstream of the at least one final rinse zone, as seen in the conveying direction, and serves, selectively as required or continuously, to spray fresh water without a disinfection chemical onto the washware to be treated. The invention makes provision for the at least one post-disinfection final rinse zone or additional final rinse zone to have an associated collection device for collecting the liquid which is sprayed, selectively as required or continuously, in the at least one post-disinfection final rinse zone or additional final rinse zone. Finally, the invention makes provision for a liquid transfer system, it being possible to supply the liquid which is collected in the collection device directly to the at least one wash zone of the conveyor dishwasher by means of said liquid transfer system, or it being possible to supply the liquid which is collected in the collection device directly to a wastewater outlet of the conveyor dishwasher by means of said liquid transfer system.

In a preferred embodiment of the conveyor dishwasher according to the invention, provision is made for the collection device which is associated with the at least one additional final rinse zone to be in the form of a tank or collection container and to be arranged with respect to final rinse nozzles which are associated with the additional final rinse zone in such a way that the liquid which is sprayed in the at least one additional final rinse zone flows into the collection device due to the force of gravity and is collected there.

In a preferred embodiment of the conveyor dishwasher according to the invention, provision is made for the liquid transfer system to have a bypass line which is or can be connected at one end to the collection device which is associated with the at least one additional final rinse zone and at the other end to the at least one wash zone, and in particular to a wash tank which is associated with the at least one wash zone. In this case, it is feasible for the liquid transfer system to have at least one pump with which the liquid which is collected in the collection device which is associated with the at least one additional final rinse zone can be supplied to the at least one wash zone, and in particular to the wash tank which is associated with the at least one wash zone, via the bypass line. The at least one pump of the liquid transfer system can preferably be actuated by means of a control device in such a way that the liquid which is collected in the collection device which is associated with the at least one additional final rinse zone is supplied continuously or at prespecified or prespecifiable times or events to the at least one wash zone, and in particular to the wash tank which is associated with the at least one wash zone, via the bypass line.

As an alternative or in addition to the provision of a bypass line which belongs to the liquid transfer system, it is equally feasible for the liquid transfer system to have an outlet line which is or can be connected at one end to the collection device which is associated with the at least one additional final rinse zone and at the other end to a wastewater outlet of the conveyor dishwasher. In this case, it is feasible, in particular, for it to be possible for the outlet line to be connected to the wastewater outlet of the conveyor dishwasher via a valve. The valve can preferably be actuated by means of a control device in such a way that the liquid which is collected in the collection device which is associated with the at least one additional final rinse zone is supplied continuously or at prespecified or prespecifiable times or events to the wastewater outlet of the conveyor dishwasher via the outlet line.

In a development of the conveyor dishwasher according to the invention, provision is made for the at least one final rinse zone, in which final rinse liquid containing a metered disinfection chemical is sprayed, to have an associated collection device which is formed separately from the collection device which is associated with the at least one additional final rinse zone, and which is designed to collect the liquid (final rinse liquid containing a metered disinfection chemical) which is sprayed in the at least one final rinse zone. In this case, it is feasible, in particular, for the conveyor dishwasher according to the invention to have at least one pre-rinse zone, which is arranged upstream of the at least one final rinse zone and downstream of the at least one wash zone as seen in the conveying direction, for spraying the liquid which is collected in the collection device which is associated with the at least one final rinse zone onto the washware to be treated.

It is preferred, in principle, when the conveyor dishwasher according to the invention is provided with a metering device for metering a disinfection chemical into the liquid which is to be sprayed in the at least one final rinse zone in such a way that the liquid contains a predefinable or predefined minimum concentration of disinfection chemicals which depends on the type of metered disinfection chemical.

If the conveyor dishwasher has at least one pre-rinse zone, which is arranged upstream of the at least one final rinse zone and downstream of the at least one wash zone as seen in the conveying direction, it is preferred when a metering device is provided for metering a disinfection chemical into the liquid which is sprayed in the at least one final rinse zone and which is to be sprayed in the at least one pre-rinse zone and/or for metering a disinfection chemical into the liquid which is to be sprayed in the at least one final rinse zone in such a way that the liquid which is sprayed in the at least one final rinse zone and the liquid which is sprayed in the at least one pre-rinse zone have a predefinable or predefined minimum concentration of disinfection chemicals which depends on the type of metered disinfection chemical.

Further advantageous embodiments of the conveyor dishwasher according to the invention are specified in the dependent patent claims.

The advantages which can be achieved by virtue of the solution according to the invention are obvious: providing at least one post-disinfection final rinse zone or additional final rinse zone which is arranged downstream of the final rise zone in which final rinse liquid containing a metered disinfection chemical is sprayed onto the washware to be treated, and in which post-disinfection final rinse zone or additional final rinse zone fresh water without a disinfection chemical is sprayed onto the washware to be treated, ensures that residues of the disinfection chemical which is sprayed in the final rinse zone which may adhere to the washware are removed from the washware. The liquid which is sprayed for this purpose in the at least one post-disinfection final rinse zone or additional final rinse zone is fresh water, in particular demineralized fresh water which is of equal quality to drinking water (potable water) in microbiological terms, and therefore the washware can still be considered to be disinfected in line with the hygiene requirements applicable in the commercial dishwashing sector even after passing through the at least one post-disinfection final rinse zone or additional final rinse zone. Demi (demineralized) water is ideally used for post-disinfection final rinsing since the quality of the liquid (water) which is sprayed in the post-disinfection final rinse zone or additional final rinse zone has a significant influence on a spot-free result.

Secondly, the invention makes provision for the at least one post-disinfection final rinse zone or additional final rinse zone to have an associated collection device in which the liquid which is sprayed in the at least one post-disinfection final rinse zone or additional final rinse zone is collected, so that this liquid can be supplied directly to the at least one wash zone of the conveyor dishwasher or selectively directly to a wastewater outlet of the conveyor dishwasher by means of a liquid transfer system such that it bypasses the final rinse zone in which final rinse liquid containing a metered disinfection chemical is sprayed onto the washware to be treated. In other words, the liquid which is sprayed in the at least one post-disinfection final rinse zone or additional final rinse zone does not enter the final rinse zone which is arranged upstream of the post-disinfection final rinse zone or additional final rinse zone as seen in the conveying direction of the washware. This effectively prevents the liquid which is sprayed in the final rinse zone and to which a disinfection chemical is added in a metered manner being diluted with further liquid into which no disinfection chemical has been metered.

If the conveyor dishwasher has a pre-rinse zone which is arranged upstream of the at least one final rinse zone of the conveyor dishwasher and downstream of the at least one wash zone of the conveyor dishwasher as seen in the conveying direction and in which the liquid which is collected with the aid of a collection device which is associated with the final rinse zone is sprayed onto the washware to be treated, it is equally ensured that the liquid which is to be sprayed onto the washware in the pre-rinse zone cannot be diluted by the liquid which is sprayed in the post-disinfection final rinse zone or additional final rinse zone and into which no disinfection chemical is metered, since the liquid which is sprayed in the post-disinfection final rinse zone or additional final rinse zone is supplied directly to the at least one wash zone of the conveyor dishwasher or selectively directly to a wastewater outlet of the conveyor dishwasher by the liquid transfer system.

Bypassing the final rinse zone or pre-rinse zone which is used for disinfecting the washware, this being achieved with the aid of the liquid transfer system, has the advantage that a lower quantity of the disinfection chemical has to be used to be able to keep the required minimum concentration of disinfection chemical in the final rinse zone or in the final rinse zone and the pre-rinse zone. As already mentioned, the minimum concentration of disinfection chemical depends on the type of disinfection chemical used and is, for example, 50 ppm when sodium hypochlorite (NaOCl) is used as the disinfection chemical.

In order to save on detergent chemicals, it is additionally expedient to bypass the (main-) wash zone(s) which is/are arranged upstream of the final rinse zone or pre-rinse zone as seen in the conveying direction and into which a detergent chemical is usually metered with the aid of the bypass line which belongs to the liquid transfer system, and to supply the liquid which is sprayed in the post-disinfection final rinse zone or additional final rinse zone to a pre-wash zone which is arranged upstream of the (main-) wash zone(s).

The disinfection chemical used is preferably chlorine dioxide ($ClO_2$) or sodium hypochlorite (NaOCl), but ozone ($O_3$) or an iodine solution or quaternary ammonium solutions are also suitable. In the process, the disinfection chemical is metered only into the final rinse zone which is used for disinfection, or alternatively also into the final rinse zone which is used for disinfection and into a pre-rinse zone which is connected upstream of said final rinse zone if the conveyor dishwasher has a pre-rinse zone of this kind. To this end, the pre-rinse zone can also have its own metering device—or share a metering device with the final rinse zone—for introducing the disinfection chemical.

In a further aspect of the invention, a sensor device which is designed to detect the type of washware to be treated in the conveyor dishwasher is provided. The at least one post-disinfection final rinse zone or additional final rinse zone can then be connected or disconnected with the aid of a control device, as a function of the type of washware detected, in order to prevent excessive treatment of the washware and save on resources (water and energy). This ensures that final rinsing with fresh water is performed in the at least one post-disinfection final rinse zone or additional final rinse zone only for vulnerable washware, in particular drinking glasses and/or flatware, with this final rinsing with fresh water being dispensed with for less vulnerable washware, for example trays.

In order to achieve as high a level of energy efficiency as possible, the washing and/or rinsing temperatures in the conveyor dishwasher according to the invention are below 60° C., preferably below 55° C. The rinsing temperature in the final rinse zone in which final rinse liquid containing a metered disinfection chemical is sprayed is preferably equal to or less than the rinsing temperature in the post-disinfection final rinse zone or additional final rinse zone in which fresh water without a metered disinfection chemical is sprayed.

The rinsing result can be improved even further when the rinsing temperature in the final rinse zone in which final rinse liquid is sprayed with a metered disinfection chemical is less than 60° C. and the rinsing temperature in the post-disinfection final rinse zone or additional final rinse zone in which fresh water without a metered disinfection chemical is sprayed is greater than 60° C.

The conveyor dishwasher according to the invention is particularly suitable as a multipurpose system MPW (multipurpose washer), as is often used in the field of airline catering, for example.

In respect of the method according to the invention for operating a conveyor dishwasher, provision is made for the washware to be cleaned to be conveyed through at least one wash zone and at least one final rinse zone with the aid of a conveyor apparatus, with the at least one final rinse zone being arranged downstream of the at least one wash zone as seen in the conveying direction of the washware which is conveyed using the conveyor apparatus, and with final rinse liquid being sprayed onto the washware to be treated in the at least one final rinse zone. The invention makes provision for a disinfection chemical to be added in a metered manner to the final rinse liquid which is to be sprayed in the at least one final rinse zone, for the washware which is treated in the at least one final rinse zone to then be conveyed through at least one additional final rinse zone in which fresh water without a disinfection chemical is sprayed onto the washware, preferably as a function of the type of washware to be treated, for the liquid which is sprayed in the at least one additional final rinse zone to be collected by a collection device which is associated with the at least one additional final rinse zone, and for the liquid which is collected in the collection device to be supplied directly to the at least one wash zone or to a wastewater outlet of the conveyor dishwasher.

In the text which follows, the invention will be described using exemplary embodiments with reference to the drawings, in which.

Figure 1:
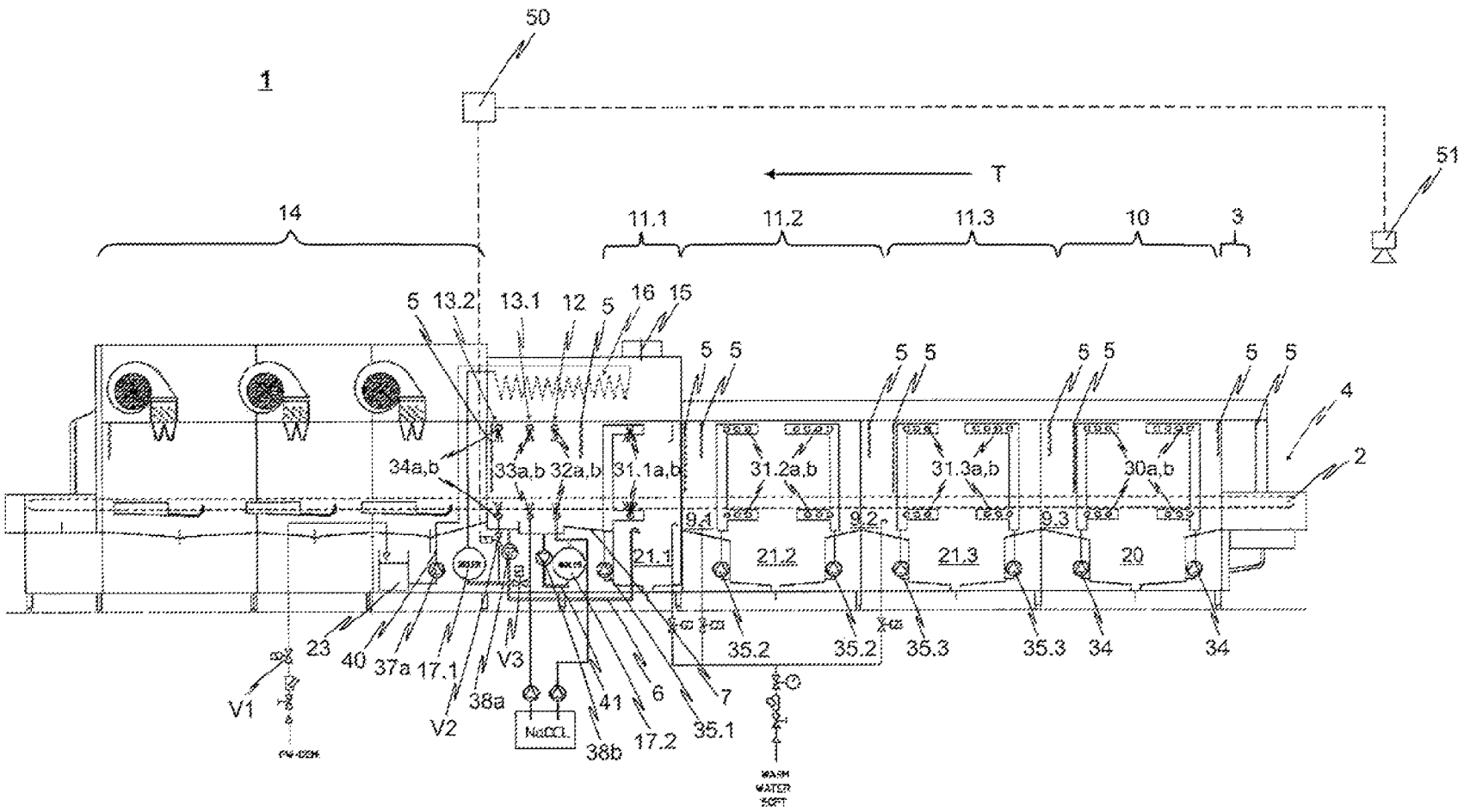
FIG. 1 shows a schematic side view of a conveyor dishwasher according to a first embodiment of the invention.

FIG. 1 shows a schematic side view of a conveyor dishwasher 1 according to a first embodiment of the invention having a conveyor apparatus 2 for conveying washware (not illustrated) in a conveying direction T through the conveyor dishwasher 1. The conveyor dishwasher 1 has at least one wash zone, as illustrated in FIG. 1 for example, a pre-wash zone 10 and three main-wash zones 11.1, 11.2, 11.3 which are arranged downstream of the pre-wash zone 10 as seen in the conveying direction T.

As seen in the conveying direction T, a post-wash zone or pre-rinse zone 12 is arranged downstream of the at least one wash zone 10, 11.1, 11.2, 11.3, and at least one final rinse zone, for example only a first final rinse zone 13.1 as illustrated, in which final rinse liquid containing a metered disinfection chemical is sprayed onto the washware, and a second additional final rinse zone or post-disinfection final rinse zone 13.2, in which fresh water without a metered disinfection chemical is sprayed onto the washware continuously or as required, are arranged downstream of the post-wash zone or pre-rinse zone 12. In the conveyor dishwasher 1 illustrated in FIG. 1, the additional final rinse zone or post-disinfection final rinse zone 13.2 is followed by a drying zone 14 as seen in the conveying direction T of the washware.

The respective zones 10, 11.1, 11.2, 11.3, 12, 13.1, 13.2 and of the conveyor dishwasher 1 can be separated from one another by means of separating curtains 5. In the embodiment illustrated in FIG. 1, the inlet tunnel 3 of the conveyor dishwasher 1 itself is also separated from the machine inlet 4 by a separating curtain 5. The provision of the separating curtains 5 prevents wash liquid and final rinse liquid spraying between zones and prevents vapors escaping from the conveyor dishwasher 1.

Said treatment zones 10, 11.1, 11.2, 11.3, 12, 13.1 and 13.2 of the conveyor dishwasher 1 have associated spray nozzles 30*a*, 30*b*, 31.1*a*, 31.1*b*, 31.2*a*, 31.2*b*, 31.3*a*, 31.3*b*, 32*a*, 32*b*, 33*a*, 33*b*, 34*a* and 34*b*. These spray nozzles 30*a*, 30*b*, 31.1*a*, 31.1*b*, 31.2*a*, 31.2*b*, 31.3*a*, 31.3*b*, 32*a*, 32*b*, 33*a*, 33*b*, 34*a* and 34*b* serve to spray liquid onto the washware to be treated as said washware is conveyed through the respective treatment zones 10, 11.1, 11.2, 11.3, 12, 13.1 and 13.2 by the conveyor apparatus 2. The individual spray systems of the treatment zones 10, 11.1, 11.2, 11.3, 12, 13.1 and 13.2 ensure that the washware to be treated is hosed down both from the top and from the bottom. It would also be feasible to additionally further provide lateral spray nozzles.

The main-wash zones 11.1, 11.2, 11.3 and the pre-wash zone 10 also have associated tanks (main-wash tanks 21.1, 21.2, 21.3, pre-wash tank 20) for accommodating sprayed liquid and/or for providing liquid for the spray nozzles 30*a*, 30*b*, 31.1*a*, 31.1*b*, 31.2*a*, 31.2*b*, 31.3*a* and 31.3*b* of the relevant treatment zones 10, 11.1, 11.2, 11.3 and 12.

The additional final rinse zone or post-disinfection final rinse zone 13.2 has an associated collection device 22.2 for collecting liquid which is sprayed in the additional final rinse zone 13.2. As illustrated, the collection device 22.2 which is associated with the additional final rinse zone 13.2 can be in the form of a tank or in the form of a collection container, the intention being for this collection device 22.2 to be arranged with respect to the spray nozzles (final rinse nozzles) 34*a*, 34*b* which are associated with the additional final rinse zone 13.2 in such a way that the liquid which is sprayed in the additional final rinse zone 13.2 flows into the collection device 22.2 due to the force of gravity and is collected there.

Figure 2:
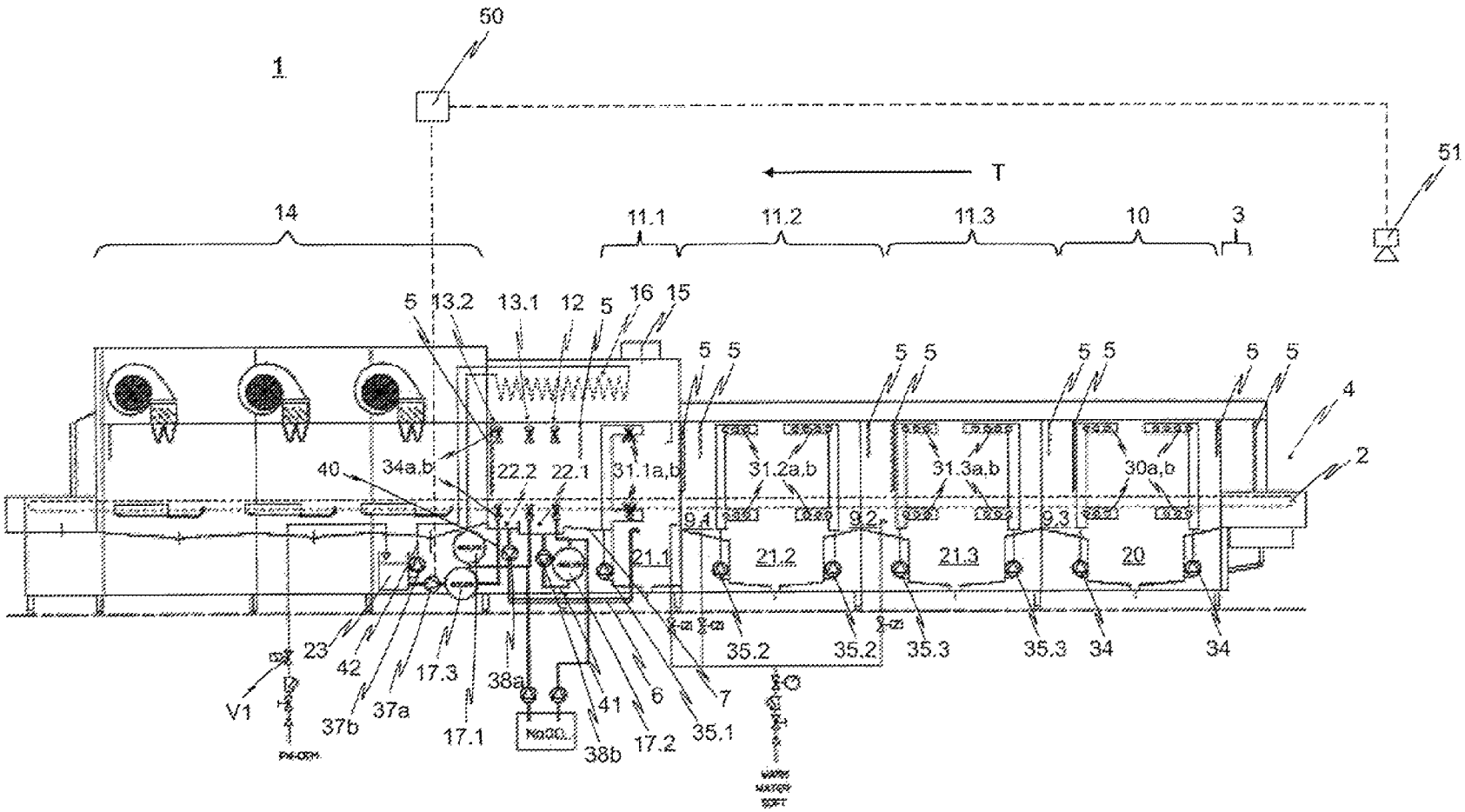
FIG. 2 shows a schematic side view of a conveyor dishwasher according to a second embodiment of the invention.

In the illustrated embodiment, the final rinse zone 13.1 which is arranged upstream of the additional final rinse zone or post-disinfection final rinse zone 13.2 likewise has an associated collection device—in this case in the form of a tank—which is denoted by the reference numeral "22.1" in FIG. 2. Said collection device 22.1 which is associated with the final rinse zone 13.1 is formed separately from the collection device 22.2 which is associated with the additional final rinse zone 13.2 and therefore serves to collect the liquid which is sprayed in the final rinse zone 13.1. The liquid which is collected in the collection device 22.1 which is associated with the final rinse zone 13.1 is supplied to the spray nozzles 32*a*, 32*b* which are associated with the pre-rinse zone 12 with the aid of a pump (pre-rinse pump 38*b*).

In the conveyor dishwasher 1 which is illustrated in FIG. 1, final rinse liquid, which is made up of fresh water with a rinse aid which may be added in a metered manner and is of equal quality to drinking water in microbiological terms, is sprayed in the additional final rinse zone or post-disinfection final rinse zone 13.2 onto the washware (not illustrated) by means of the final rinse nozzles 34*a*, 34*b* which are arranged above and below the conveyor apparatus 2 and optionally also to the sides of said conveyor apparatus. The final rinse liquid which is sprayed in the additional final rinse zone or post-disinfection final rinse zone 13.2 is collected in the collection device 22.2 which is associated with the additional final rinse zone or post-disinfection final rinse zone 13.2 and, in particular, does not enter the final rinse zone 13.1 which is arranged upstream of the additional final rise zone or post-disinfection final rinse zone 13.2.

In the final rinse zone 13.1 however, final rinse liquid, which is made up of fresh water with metered disinfection chemical and possibly metered rinse aid, is sprayed onto the washware (not illustrated) by means of the final rinse nozzles 33*a*, 33*b* which are arranged above and below the conveyor apparatus 2 and optionally also to the sides of said conveyor apparatus. The liquid which is sprayed in the final rinse zone 13.1 is collected in the collection device 22.1 which is associated with the final rinse zone 13.1 and is then supplied to the pre-rinse nozzles 32*a*, 32*b* of the pre-rinse zone 12 with the aid of the pre-rinse pump 38*b*. Wash liquid is rinsed off from the washware in the pre-rinse zone 12. The liquid (pre-rinse liquid) which is sprayed onto the washware (not illustrated) by the pre-rinse nozzles 32*a*, 32*b* in the pre-rinse zone 12 is conveyed from treatment zone to treatment zone by means of a cascade system in the opposite direction to the conveying direction T of the washware. However, it would also be feasible here for only a portion of the liquid which is sprayed in the pre-rinse zone 12 to be conveyed by means of the cascade system in the opposite direction to the conveying direction T, while the remaining portion of the pre-rinse liquid which is sprayed in the pre-rinse zone 12 is conducted directly to the pre-wash tank 20, which is associated with the pre-wash zone 10, via a valve (not illustrated) and a bypass line (not illustrated).

In the cascade system, the pre-rinse liquid which is sprayed by the pre-rinse nozzles 32*a*, 32*b* flows from the pre-rinse zone 12 into the main-wash tank 21.1 which is associated with the (main-) wash zone 11.1 due to the force of gravity. The pre-rinse liquid which is sprayed in the pre-rinse zone 12 and collected by the main-wash tank 21.1 is then delivered to the spray nozzles of the main-wash zone 11.1 (upper and lower main-wash nozzles 31.1*a*, 31.1*b*) with the aid of a main-wash pump 35.1.

In the conveyor dishwasher 1 which is illustrated in the drawings, the final rinse zone 13.1 and the additional final rinse zone 13.2 are supplied with fresh water, with the fresh water supply being divided. A disinfection chemical, for example NaOCl, is metered into a first portion of the fresh water which is supplied to the conveyor dishwasher 1. It goes without saying that other disinfection chemicals, for example chlorine dioxide ($ClO_2$) or sodium hypochloride (NaOCl) or ozone ($O_3$), or an iodine solution or quaternary ammonium solutions can also be used depending on requirements. The fresh water to which the disinfection chemical is admixed serves, in the final rinse zone 13.1, as a final rinse liquid with a disinfection action which is discharged by means of the final rinse nozzles 33*a* and 33*b* which are associated with the final rinse zone 13.1.

A disinfection chemical is deliberately not admixed with the second portion of the fresh water which is supplied to the conveyor dishwasher 1 since this portion serves for post-disinfection final rinsing in the additional final rinse zone 13.2 and is sprayed by means of the final rinse nozzles 34*a* and 34*b* which are associated with the additional final rinse zone 13.2.

In the embodiment which is illustrated in FIG. 1, the temperature of the liquid which is sprayed in the additional final rinse zone 13.2 is at least substantially identical to the temperature of the liquid which is sprayed in the final rinse zone 13.1. The quantity of final rinse liquid which is introduced into the final rinse zone 13.1 per unit time can be adjusted via a valve V3.

In the embodiment which is illustrated in FIG. 1, the liquid which is collected in the collection device 22.2 of the post-disinfection final rinse zone or additional final rinse zone 13.2 is supplied cyclically to the last main-wash zone 11.1 which immediately adjoins the pre-rinse zone 12, and in particular to the main-wash tank 21.1 which is associated with the main-wash zone 11.1, by means of a liquid transfer system comprising a pump 38*a* and a bypass line 6. However, as an alternative to this, it would be also feasible when the liquid which is collected in the collection device 22.2 is pumped out of the collection device 22.2, which is in the form of a tank, in a manner controlled with respect to time or level.

The final rinse liquid into which the disinfection chemical has been metered is collected in the collection device 22.1, which is likewise in the form of a tank, after being sprayed by means of the final rinse nozzles 33*a* and 33*b* which are associated with the final rinse zone 13.1, and then serves as a pre-rinse liquid in the pre-rinse zone 12. To this end, a pump 38*b* is provided, this pump pumping the liquid which is sprayed in the final rinse zone 13.1 and collected in the collection device 22.1 out of the collection device 22.1 which is in the form of a tank and supplying it to the pre-rinse nozzles 32*a* and 32*b*.

In the embodiment which is illustrated in FIG. 1, provision is made for it to be possible for the disinfection chemical (here: NaOCl) to be metered both into the final rinse liquid which is to be sprayed in the final rinse zone 13.1 and also into the pre-rinse liquid which is to be sprayed in the pre-rinse zone 12. To this end, a first metering device (metering pump), which is associated with the final rinse zone 13.1, and a second metering device (metering pump), which is formed and can be actuated independently of said first metering device, are provided, with the second metering device (metering pump) being associated with the pre-rinse zone 12. In both cases, the corresponding metering device (metering pump) is adjusted or actuated in such a way that the final rinse liquid which is sprayed in the final rinse zone 13.1 and the pre-rinse liquid which is sprayed in the pre-rinse zone 12 have a predefinable or predefined minimum concentration of disinfection chemical which depends on the type of metered disinfection chemical. As already indicated, a minimum concentration of 50 ppm is required when sodium hypochlorite (NaOCl) is used as the disinfection chemical.

Wash liquid is rinsed off from the washware in the pre-rinse zone 12. The liquid produced in the process flows into the main-wash tank 21.1, which is associated with the first main-wash zone 11.1, due to the force of gravity. A discharge element 7, for example a discharge base or a baffle plate, which conducts the pre-rinse liquid which is sprayed by the pre-rinse nozzles 32*a*, 32*b* into the main-wash tank 21.1 is preferably provided for this purpose. According to another embodiment (not shown) of the conveyor dishwasher 1, the discharge element 7 can be dispensed with if the main-wash tank 21.1 extends as far as beneath the pre-rinse nozzles 32*a*, 32*b* of the pre-rinse zone 12.

The liquid which is accommodated in the main-wash tank 21.1 of the first main-wash zone 11.1 is usually provided with a detergent and sprayed onto the washware by means of the spray nozzles of the first main-wash zone 11.1 (upper and lower main-wash nozzles 31.1*a*, 31.1*b*) with the aid of a first main-wash pump 35.1. The wash liquid which is sprayed by the main-wash nozzles 31.1*a*, 31.1*b* then flows back into the main-wash tank 21.1 due to the force of gravity.

The main-wash tank 21.1 is fluidically connected to the main-wash tank 21.2 which is associated with the second main-wash zone 11.2 via an overflow line 9.1. The wash liquid which is sprayed in the first main-wash zone 11.1 enters the main-wash tank 21.2 of the second main-wash zone 11.2 via this overflow line 9.1 when there is a sufficient quantity of wash liquid in the main-wash tank 21.1 of the first main-wash zone 11.1.

The liquid which is accommodated in the main-wash tank 21.2 of the second main-wash zone 11.2 is sprayed onto the washware by means of the spray nozzles of the second main-wash zone 11.2 (upper and lower main-wash nozzles 31.2*a*, 31.2*b*) with the aid of second main-wash pumps 35.2. The wash liquid which is sprayed by the main-wash nozzles 31.2*a*, 31.2*b* then flows back into the main-wash tank 21.2 of the second main-wash zone 11.2 due to the force of gravity.

The main-wash tank 21.2 of the second main-wash zone 11.2 is fluidically connected to the pre-wash tank 20 which is associated with the pre-wash zone 10 via an overflow line 9.2. The wash liquid which is sprayed in the second main-wash zone 11.2 enters the main-wash tank 21.3 via this overflow line 9.2 when there is a sufficient quantity of wash liquid in the main-wash tank 21.2 of the second main-wash zone 11.2.

The liquid which is accommodated in the main-wash tank 21.3 of the third main-wash zone 11.3 is sprayed onto the washware by means of the spray nozzles of the third main-wash zone 11.3 (upper and lower main-wash nozzles 31.3*a*, 31.3*b*) with the aid of third main-wash pumps 35.3. The wash liquid which is sprayed by the main-wash nozzles 31.3*a*, 31.3*b* then flows back into the main-wash tank 21.3 of the third main-wash zone 11.3 due to the force of gravity.

The main-wash tank 21.3 of the third main-wash zone 11.3 is fluidically connected to the pre-wash tank 20 which is associated with the pre-wash zone 10 via an overflow line 9.3. The wash liquid which is sprayed in the third main-wash zone 11.3 enters the pre-wash tank 20 via this overflow line 9.3 when there is a sufficient quantity of wash liquid in the main-wash tank 21.3 of the third main-wash zone 11.3.

The liquid which is accommodated in the pre-wash tank 20 of the pre-wash zone 10 is then sprayed onto the washware by means of the spray nozzles of the pre-wash zone 10 (upper and lower pre-wash nozzles 30*a*, 30*b*) with the aid of pre-wash pumps 34 in order to remove coarse particles of dirt from the washware. The wash liquid which is sprayed by the pre-wash nozzles 30*a*, 30*b* then flows back into the pre-wash tank 20 due to the force of gravity.

As already indicated, the liquid which is sprayed in the main-wash zones 11.1, 11.2 and 11.3 and in the pre-wash zone 10 preferably contains detergent which is added in a metered fashion with the aid of a detergent metering apparatus (not shown in the drawings), for example, to the liquid which is accommodated in the main-wash tank 21.1 of the first main-wash zone 11.1.

The additional final rinse zone or post-disinfection final rinse zone 13.2 is followed by the abovementioned drying zone 14 in the conveying direction T. In the drying zone 14, the washware is dried using dry and heated air in order to blow off and/or dry up the moisture on the washware. In order to keep the moisture content of the air in a range which is expedient for drying, it is feasible, for example, to supply ambient air to the drying zone 14 from outside via an opening, for example through the outlet opening for the washware.

The warm and moisture-laden air in the drying zone 14 is then drawn-off from the drying zone 14 via a further opening, for example with the aid of a fan 15. It is advantageous here when the exhaust air stream from the drying zone 14 passes a heat-recovery device 16 in which, for example, a condenser can be provided. The heat-recovery device 16 serves to recover at least some of the thermal energy contained in the exhaust air. This recovered thermal energy can be used, for example, to heat the liquid which is sprayed in the final rinse zones 13.1 and 13.2.

The final rinse zones 13.1, 13.2 can have an associated common fresh water container 23 in order to temporarily store at least a portion of the fresh water which is provided for final rinsing (disinfection final rinsing and post-disinfection final rinsing). The fresh water container 23 is firstly provided with a fresh water connection which can be connected to a fresh water supply system via an actuable fresh water feed valve V1. Secondly, the fresh water container 23 is connected to the intake end of a first final rinse pump 37*a*.

The delivery end of the first final rinse pump 37*a* is connected to the upstream end region of a first line system 40, by means of which first line system fresh water is delivered from the fresh water container 23 to the final rinse nozzles 33*a*, 33*b*, 34*a* and 34*b* when the first final rinse pump 37*a* is operated. Specifically, the first line system 40 connects the delivery end of the first final rinse pump 37*a* to a throughflow heater 17.1 (boiler). In this case, the first line system 40 is formed in such a way that the liquid which is supplied from the first final rinse pump 37*a* to the final rinse nozzles 33*a*, 33*b*, 34*a* and 34*b* first passes the heat-recovery device 16 before reaching the throughflow heater 17.1. In this way, it is possible to use at least some of the thermal energy from the exhaust air which is discharged from the drying zone 14 to heat the liquid which is supplied to the spray nozzles 33*a*, 33*b*, 34*a* and 34*b* by means of the first line system 40. The fresh water which is supplied by means of the first line system 40 is therefore correspondingly heated.

A second line system 41 connects the collection device 22.1, which is in the form of a tank and is associated with the final rinse zone 13.1, to the pre-rinse nozzles 32*a* and 32*b* of the pre-rinse zone 12 by means of a throughflow heater 17.2 (boiler). The temperature of the liquid which is supplied to the pre-rinse nozzles 32*a* and 32*b* can therefore be controlled independently of the temperature of the final rinse liquid which is sprayed in the final rinse zone 13.1 and in the additional final rinse zone 13.2. The washing and/or rinsing temperatures are preferably less than 60° C. and are preferably below 55° C. in this case.

In order to detect the type of washware to be treated in the conveyor dishwasher 1, the illustrated conveyor dishwasher 1 has a sensor device 51. The term "sensor device" used here is to be understood as any detection apparatus which is designed to detect and/or to determine the type of washware to be treated in the conveyor dishwasher 1. It is feasible for the sensor device 51 to have at least one detector device which can detect the size and/or the shape and/or the material of the washware to be treated in the conveyor dishwasher 1. In one possible embodiment of the sensor device 51, it comprises at least one preferably optically, inductively or capacitively operating detector device, so that the size, the shape and/or the material of the washware can be detected for the purpose of identifying the type of washware. However, other types of detector, for example inductively/capacitively operating proximity sensors, reed switches, Hall sensors, light sensors, light curtains, laser scanners, 3D lasers, cameras, rotary transducers, etc., can also be used as the detector device.

As illustrated in FIG. 1, in the exemplary embodiment of the conveyor dishwasher 1 according to the invention, the sensor device 51 is preferably arranged at the inlet 4 to the conveyor dishwasher 1, so that it is possible to detect the type of washware to be supplied to the individual treatment zones 10, 11.1, 11.2, 11.3, 12, 13.1, 13.2 and 14 of the conveyor dishwasher 1. However, it goes without saying that it would also be feasible to arrange the sensor device 51 in the interior of the conveyor dishwasher 1. The important factor is that the sensor device 51 is arranged at least upstream of the inlet into the additional final rinse zone 13.2. The distance between the sensor device 51 and the inlet into the additional final rinse zone 13.2 depends on the reaction time with which the second final rinse zone 13.2 can be activated when the sensor device 51 identifies a predefined type of washware, in particular flatware and/or glasses.

The control device 50 is connected to the sensor device 51 via a suitable communication connection, in order for the type of washware which is to be supplied to the second final rinse zone 13.2 and is detected by the sensor device 51 to be checked continuously or at predetermined times and/or events. In order to activate the second final rinse zone 13.2, the control unit 50 is connected to a valve V2 via a further suitable communication connection, said valve controlling the supply of final rinse liquid to the final rinse nozzles 34*a* and 34*b* which are associated with the additional final rinse zone 13.2.

As already mentioned, in the embodiment of the conveyor dishwasher 1 which is illustrated in FIG. 1, the control device 50 is designed to automatically identify the washware to be treated on the basis of the type of washware which is detected by the sensor device 51. The control device 50 can preferably automatically identify at least the following washware:

- plates which are produced from porcelain or a porcelain-like material;
- cups, bowls and drinking glasses which are produced from glass or a glass-like material;
- trays, or tray-like articles, which are produced from a plastics material; and
- drinking glasses which are produced from glass or a glass-like material.

If the control device 50 does not identify the washware on the basis of the type of washware which is detected by the sensor device 51, the relevant washware is identified as "other washware".

In a preferred embodiment of the conveyor dishwasher 1 according to the invention, the sensor device 51 is further designed to automatically identify the absence of washware. Accordingly, when there are empty regions (empty compartments) between the washware which is supplied to the individual treatment zones 10, 11.1, 11.2, 11.3, 12, 13.1, 13.2 and 14 by the conveyor apparatus 2, this is preferably identified with the aid of the sensor device 51.

The control device 50 is preferably designed to the effect that it:

- automatically actuates the valve V2 in such a way that the supply of final rinse liquid to the final rinse nozzles 34*a* and 34*b* which are associated with the additional final rinse zone 13.2 is interrupted when plastic washware, in particular plastic trays, is/are identified; and/or
- automatically actuates the valve V2 in such a way that the supply of final rinse liquid to the final rinse nozzles 34*a* and 34*b* which are associated with the additional final rinse zone 13.2 is interrupted when porcelain washware or washware which is composed of a porcelain-like material is identified; and/or
- automatically actuates the valve V2 in such a way that the supply of final rinse liquid to the final rinse nozzles 34*a* and 34*b* which are associated with the additional final rinse zone 13.2 is interrupted when the absence of washware is identified; and/or
- automatically actuates the valve V2 in such a way that final rinse liquid is supplied to the final rinse nozzles 34*a* and 34*b* which are associated with the additional final rinse zone 13.2 when glasses or racks of glasses are identified; and/or
- automatically actuates the valve V2 in such a way that final rinse liquid is supplied to the final rinse nozzles 34*a* and 34*b* which are associated with the additional final rinse zone 13.2 when flatware or racks of flatware are identified.

Excessive treatment and inadequate treatment of the washware in the second final rinse zone 13.2 can be effectively prevented in this way. It should be noted here that glass washware or washware which is composed of a glass-like material and items of flatware are particularly critical items of washware since remaining traces of the disinfection chemical after disinfection treatment in the final rinse zone 13.1 can be particularly clearly identified on this washware. Post-disinfection final rinsing should accordingly be performed in the additional final rinse zone 13.2 at least when glass washware and items of flatware are treated in the conveyor dishwasher 1.

FIG. 2 shows a schematic side view of a conveyor dishwasher 1 according to a second embodiment of the invention. The conveyor dishwasher 1 corresponds substantially to the conveyor dishwasher 1 described above with reference to the illustration in FIG. 1, and therefore the design and manner of operation of identical or identically acting components will not be described. As in the embodiment illustrated in FIG. 1, the conveyor dishwasher 1 according to FIG. 2 exhibits metering sodium hypochlorite (NaOCl) into the final rinse zone 13.1 and into the pre-rinse zone 12.

The second embodiment according to FIG. 2 differs from the above-described conveyor dishwasher 1 in that the fresh water supply to the final rinse zone 13.1 and the fresh water supply to the additional final rinse zone 13.2 are independent of one another. To this end, the final rinse zone 13.1 has an associated line system 42 which contains a pump 37*b*. The additional final rinse zone 13.2 has an associated line system 40 with a pump 37*a*. The two line systems 40 and 42 are each equipped with a so-called fresh water boiler or through-flow heater 17.1 and, respectively, 17.3, and therefore different process temperatures can be set for the liquid which is to be sprayed in the final rinse zone 13.1 and for the liquid which is to be sprayed in the additional final rinse zone 13.2.

In this case, the process temperature in the final rinse zone 13.1 should preferably be equal to or less than the process temperature in the additional final rinse zone 13.2. The process temperature in the final rinse zone 13.1 is particularly preferably less than 60° C. and the process temperature in the additional final rinse zone 13.2 is particularly preferably greater than 60° C.

In order to activate the additional final rinse zone 13.2, the control unit 50 is connected to the pump 37*a* by means of a communication connection in the embodiment illustrated in FIG. 2. When a predefined type of washware, such as in particular flatware and/or glasses, is identified by the sensor device 51, the pump 37*a* is actuated and preferably demineralized water is supplied to the final rinse nozzles 34*a* and 34*b* which are associated with the additional final rinse zone 13.2.

Figure 3:
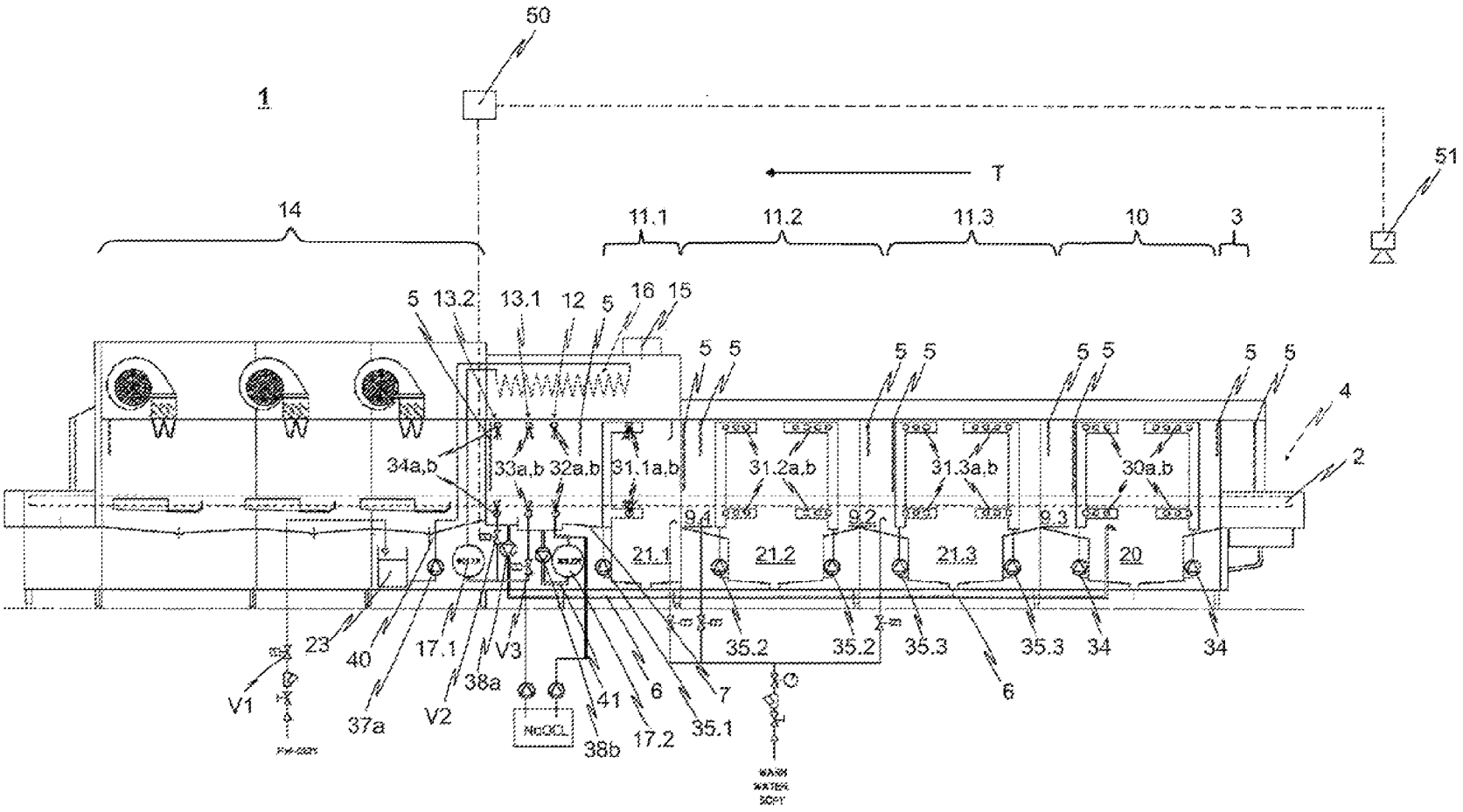
FIG. 3 shows a schematic side view of a conveyor dishwasher according to a third embodiment of the present invention.

FIG. 3 shows a schematic side view of a conveyor dishwasher 1 according to a third embodiment of the invention. This embodiment corresponds substantially to the conveyor dishwasher 1 already described above with reference to the illustration in FIG. 1, with the difference that the liquid which is collected in the collection device 22.2 of the additional final rinse zone 13.2 is pumped, preferably cyclically, into the pre-wash tank 20 of the pre-wash zone 10 by means of the pump 38*a*, which belongs to the liquid transfer system, and the bypass line 6.

Figure 4:
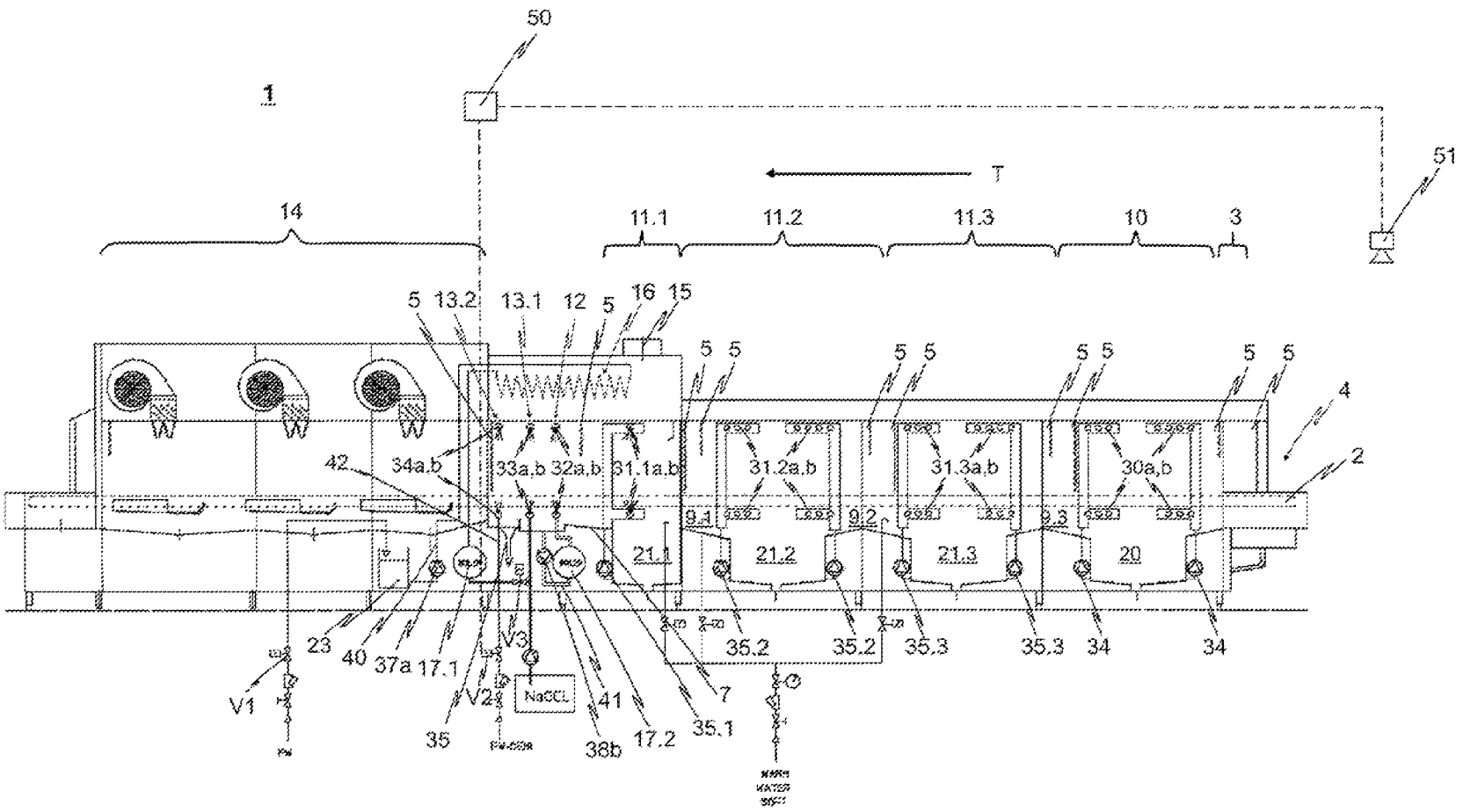
FIG. 4 shows a schematic side view of a conveyor dishwasher according to a fourth embodiment of the invention.

FIG. 4 shows a schematic side view of a conveyor dishwasher 1 according to a fourth embodiment of the invention. This embodiment corresponds substantially to the conveyor dishwasher 1 described above with reference to the illustration in FIG. 1. It shows the simplest embodiment of the invention in which only one metering device (metering pump), which is associated with the final rinse zone 13.1, is provided for metering a disinfection chemical into the liquid which is to be sprayed in the final rinse zone 13.1. Metering is performed in such a way that the liquid which is to be sprayed in the final rinse zone 13.1 contains a predefinable or predefined minimum concentration of disinfection chemicals which depends on the type of metered disinfection chemical.

In the embodiment illustrated in FIG. 4, the liquid transfer system does not have a bypass line—in contrast to the above-described embodiments. Instead, in the embodiment according to FIG. 4, the liquid transfer system is formed by an outlet line 35 which is or can be connected at one end to the collection device 22.2 which is associated with the additional final rinse zone 13.2 and at the other end to a wastewater outlet of the conveyor dishwasher 1.

Each of the embodiments of the conveyor dishwasher 1 according to the invention allows the consumption of rinse aid, disinfection chemical and energy for the washware to be treated to be reduced while at the same time providing an optimum final rinse result, with all the requirements in respect of hygiene performance additionally being complied with, by virtue of specific process control. In this case, the invention is not restricted to the exemplary embodiments described above, but rather can be gathered from looking at all the individual features disclosed in said exemplary embodiments together.

The invention claimed is:

1. A conveyor dishwasher having at least one wash zone and at least one final rinse zone which is arranged downstream of the at least one wash zone, and having a conveyor apparatus for conveying washware through the at least one wash zone and the at least one final rinse zone, with a final rinse liquid which is sprayed onto the washware to be treated in the at least one final rinse zone having a metered disinfection chemical, and with at least one additional final rinse zone which is arranged downstream of the at least one final rinse zone as seen in a conveying direction being provided for spraying fresh water without a disinfection chemical onto the washware to be treated;

characterized in that the at least one final rinse zone has an associated collection device for collecting liquid which is sprayed in the at least one final rinse zone;

in that the at least one additional final rinse zone has an associated collection device for collecting liquid which is sprayed in the at least one additional final rinse zone, wherein the collection device associated with the at least one additional final rinse zone is separate from the collection device associated with the at least one final rinse zone, wherein the collection device associated with the at least one additional final rinse zone is not connected to deliver liquid for spraying in the at least one final rinse zone; and in that a liquid transfer system is provided, it being possible to supply the liquid which is collected in the collection device of the at least one additional final rinse zone directly to the at least one wash zone by means of said liquid transfer system, or it being possible to supply the liquid which is collected in the collection device of the at least one additional final rinse zone directly to a wastewater outlet of the conveyor dishwasher by means of said liquid transfer system, in either case such that the liquid collected in the collection device of the at least one additional final rinse zone bypasses the collection device of the at least one final rinse zone in order to avoid diluting liquid in the collection device of the at least one final rinse zone.

2. The conveyor dishwasher as claimed in claim 1, with the collection device which is associated with the at least one additional final rinse zone being in the form of a tank or collection container and being arranged with respect to final rinse nozzles which are associated with the additional final rinse zone in such a way that the liquid which is sprayed in the at least one additional final rinse zone flows into the collection device due to the force of gravity and is collected there.

3. The conveyor dishwasher as claimed in claim 1, with the liquid transfer system having a bypass line which is or can be connected at one end to the collection device which is associated with the at least one additional final rinse zone and at the other end to a wash tank which is associated with the at least one wash zone.

4. The conveyor dishwasher as claimed in claim 3, with the liquid transfer system having at least one pump with which the liquid which is collected in the collection device which is associated with the at least one additional final rinse zone can be supplied to the wash tank which is associated with the at least one wash zone via the bypass line.

5. The conveyor dishwasher as claimed in claim 4, it being possible to actuate the at least one pump by means of a control device in such a way that the liquid which is collected in the collection device which is associated with the at least one additional final rinse zone is supplied continuously or at prespecified or prespecifiable times or events to the wash tank which is associated with the at least one wash zone via the bypass line.

6. The conveyor dishwasher as claimed in claim 1, with the liquid transfer system having an outlet line which is or can be connected at one end to the collection device which is associated with the at least one additional final rinse zone and at the other end to a wastewater outlet of the conveyor dishwasher.

7. The conveyor dishwasher as claimed in claim 6, it being possible for the outlet line to be connected to the wastewater outlet of the conveyor dishwasher via a valve, it being possible for the valve to be actuated by means of a control device in such a way that the liquid which is collected in the collection device which is associated with the at least one additional final rinse zone is supplied continuously or at prespecified or prespecifiable times or events to the wastewater outlet of the conveyor dishwasher via the outlet line.

8. The conveyor dishwasher as claimed in claim 1, with at least one pre-rinse zone being provided, upstream of the at least one final rinse zone and downstream of the at least one wash zone as seen in the conveying direction, for spraying the liquid which is collected in the collection device which is associated with the at least one final rinse zone onto the washware to be treated.

9. The conveyor dishwasher as claimed in claim 1, with a metering device being provided for metering a disinfection chemical into the liquid which is to be sprayed in the at least one final rinse zone in such a way that the liquid contains a predefinable or predefined minimum concentration of disinfection chemicals which depends on the type of metered disinfection chemical.

10. The conveyor dishwasher as claimed in claim 8, with a metering device also being provided for metering a disinfection chemical into the liquid which is sprayed in the at least one final rinse zone and which is to be sprayed in the at least one pre-rinse zone and/or for metering a disinfection chemical into the liquid which is to be sprayed in the at least one final rinse zone in such a way that the liquid which is sprayed in the at least one final rinse zone and the liquid which is sprayed in the at least one pre-rinse zone have a predefinable or predefined minimum concentration of disinfection chemicals which depends on the type of metered disinfection chemical.

11. The conveyor dishwasher as claimed in claim 10, with the disinfection chemical containing chlorine dioxide, sodium hypochlorite, ozone, iodine or ammonium.

12. The conveyor dishwasher as claimed in claim 1, with the liquid which is sprayed in the at least one wash zone being at a temperature of less than 60° C., and/or with the liquid which is sprayed in the at least one final rinse zone being at a temperature of less than 60° C.

13. The conveyor dishwasher as claimed in claim 12, with the liquid which is sprayed in the at least one additional final rinse zone being at a temperature which is equal to or greater than the temperature of the liquid which is sprayed in the at least one final rinse zone.

14. The conveyor dishwasher as claimed in claim 1, with the liquid which is sprayed in the at least one additional final rinse zone being at a temperature of greater than 60° C. and the liquid which is sprayed in the at least one final rinse zone being at a temperature of less than 60° C.

15. The conveyor dishwasher as claimed in claim 1, with the liquid which is sprayed in the at least one additional final rinse zone being demineralized, fresh water.

16. The conveyor dishwasher as claimed in claim 1, with a sensor device being provided for detecting the type of washware to be treated in the conveyor dishwasher, and with a control device also being provided, said control device being designed to connect or disconnect the at least one additional final rinse zone as a function of the type of washware detected.

17. A method for operating a conveyor dishwasher in which method the washware to be cleaned is conveyed through at least one wash zone and at least one final rinse zone with the aid of a conveyor apparatus, with the at least one final rinse zone being arranged downstream of the at least one wash zone as seen in a conveying direction of the washware which is conveyed using the conveyor apparatus, and with final rinse liquid being sprayed onto the washware to be treated in the at least one final rinse zone, with a disinfection chemical being added in a metered manner to the final rinse liquid which is sprayed in the at least one final rinse zone, and with the washware which is treated in the at least one final rinse zone then being conveyed through at least one additional final rinse zone in which fresh water without a disinfection chemical is sprayed onto the washware, characterized in that the liquid which is sprayed in the at least one final rinse zone is collected in a first collection device which is associated with the at least one final rinse zone;

in that the liquid which is sprayed in the at least one additional final rinse zone is collected by a second collection device which is associated with the at least one additional final rinse zone, the second collection device separate from the first collection device, wherein the second collection device is not connected to deliver liquid for spraying in the at least one final rinse zone; and in that the liquid which is collected in the second collection device is supplied directly to the at least one wash zone or to a wastewater outlet of the conveyor dishwasher in order to bypass the first collection device and avoid diluting liquid in the first collection device.

18. A conveyor dishwasher having at least one wash zone and at least one downstream final rinse zone, and a conveyor apparatus for conveying washware through the at least one wash zone and the at least one final rinse zone, with final rinse liquid that is sprayed onto washware to be treated in the at least one final rinse zone having a metered disinfection chemical, and with at least one additional final rinse zone arranged downstream of the at least one final rinse zone and being provided for spraying fresh water without a disinfection chemical onto the washware to be treated;

wherein the at least one final rinse zone has an associated collection device for collecting liquid which is sprayed in the at least one final rinse zone and to supply the collected liquid to one or more spray nozzles for spraying on washware;

the at least one additional final rinse zone has an associated collection device for collecting liquid which is sprayed in the at least one additional final rinse zone, wherein the collection device associated with the at least one additional final rinse zone is separate from the collection device associated with the at least one final rinse zone, wherein the collection device associated with the at least one additional final rinse zone is not connected to deliver liquid for spraying in the at least one final rinse zone; and a liquid transfer system is provided for supplying the liquid which is collected in the collection device of the at least one additional final rinse zone directly to (i) the at least one wash zone or (ii) a wastewater outlet of the conveyor dishwasher, such that the liquid collected in the collection device of the at least one additional final rinse zone bypasses the collection device of the at least one final rinse zone in order to avoid diluting liquid in the collection device of the at least one final rinse zone.

* * * * *